US006793213B2

(12) United States Patent
Ito et al.

(10) Patent No.: US 6,793,213 B2
(45) Date of Patent: Sep. 21, 2004

(54) FEEDING APPARATUS FOR MATERIAL SHEETS

(75) Inventors: Tatsuya Ito, Tokyo (JP); Masahiro Imuta, Koriyama (JP)

(73) Assignee: Japan Tobacco, Inc., Tokyo (JP)

( * ) Notice: Subject to any disclaimer, the term of this patent is extended or adjusted under 35 U.S.C. 154(b) by 179 days.

(21) Appl. No.: 10/369,592

(22) Filed: Feb. 21, 2003

(65) Prior Publication Data

US 2003/0132569 A1 Jul. 17, 2003

Related U.S. Application Data

(63) Continuation of application No. PCT/JP01/07123, filed on Aug. 20, 2001.

(30) Foreign Application Priority Data

Aug. 22, 2000 (JP) ..... 2000-251109

(51) Int. Cl.[7] ..... B65H 3/34

(52) U.S. Cl. ..... 271/104; 271/99; 271/102; 271/106; 221/211; 400/627

(58) Field of Search ..... 271/104, 90, 99, 271/102, 100, 106; 221/211; 400/627; B65H 3/34, 3/08, 3/46

(56) References Cited

U.S. PATENT DOCUMENTS 4,921,237 A * 5/1990 Nubson et al. ..... 271/11
5,127,207 A * 7/1992 Cunningham ..... 53/396
5,171,007 A * 12/1992 Kasprzak et al. ..... 271/104
5,433,426 A * 7/1995 Bond ..... 271/92
5,553,841 A * 9/1996 Greive ..... 271/104

FOREIGN PATENT DOCUMENTS

| | | | | |
|---|---|---|---|---|
| EP | 0 915 043 A1 | * | 12/1999 | B65H/3/08 |
| JP | 44-31127 | * | 3/1979 | B65H/3/56 |
| JP | 62-83942 A | | 4/1987 | |
| JP | 03-000620 A | | 1/1991 | |
| JP | 4-223947 | * | 8/1992 | B65H/3/56 |
| JP | 5-86941 U | | 11/1993 | |
| JP | 8-12100 A | | 1/1996 | |
| JP | 2000-34029 A | | 2/2000 | |
| JP | 2000-351464 | * | 12/2000 | B65H/3/54 |

* cited by examiner

*Primary Examiner*—Donald P. Walsh
*Assistant Examiner*—Kenneth W Bower
(74) *Attorney, Agent, or Firm*—Birch, Stewart, Kolasch & Birch, LLP

(57) ABSTRACT

In a feeding apparatus for material sheets, package blanks (B) are stored stacked in layers in a hopper (2) that opens downward, for example. A plurality of stopper guides (20) are arranged at intervals in the longitudinal direction of the package blanks (B) at the outlet of the hopper (2). Restrainer lugs (24) are located continuous with the guide surfaces (22) of the stopper guides (20). The package blanks (B) are supported in layers on the stopper guides (20), and the lowest one is supported directly on the guide surfaces (22). Since guide surfaces are inclined in the direction of delivery of the package blanks (B), the lowest one of the package blanks (B) deflects to the maximum degree, and a gap is formed between the lowest package blank and the overlying package blank (B). Further, the package blank (B) can be delivered as it gets over the restrainer lugs (24) by elastic deformation.

6 Claims, 6 Drawing Sheets

FEEDING APPARATUS FOR MATERIAL SHEETS

This application is a Continuation of copending PCT International Application No. PCT/JP01/07123 filed on Aug. 20, 2001, which was not published in English and which designated the United States, and on which priority is claimed under 35 U.S.C. §120, the entire contents of which are hereby incorporated by reference.

TECHNICAL FIELD

The present invention relates to a feeding apparatus for material sheets, capable of delivering material sheets stored in layers in a hopper one after another.

BACKGROUND ART

A continuous blank feeder described in Jpn. Pat. Appln. KOKAI Publication No. 3-620 issued in Japan can be given as an example of a background art related to a feeding apparatus of this type. This conventional continuous feeder comprises a hopper that stores blanks stacked in layers and a suction head that can attract each blank and draw it out through the outlet of the hopper. The suction head can continuously deliver the blanks as it reciprocates. If the hopper outlet faces downward, for example, the opposite side edges of the stack of the blanks are supported at the hopper outlet. In this state, the lowest blank in the hopper is kept as flat as possible by means of its elastic force and detained in the hopper without dropping from the hopper outlet. As the suction head reciprocates between the hopper outlet and conveyor rollers, it first gets into the hopper and attracts the lowest blank. Then, the suction head retreats from the hopper outlet, thereby delivering the attracted blank from the hopper. The delivered blank is released from suction by the suction head and delivered onto the conveyor rollers. It is transported to a packaging machine on the conveyor rollers. Thus, the suction head can continuously perform the operation for delivering the blanks from the hopper by simply repeating the reciprocating operation. Usually, the speed of this delivery operation is set according to the production capacity of the packaging machine. If the packaging cycle is speeded up, therefore, the blank delivery speed is also increased.

In a delivery manner using the suction head and the like described above, the blanks stacked in layers in the hopper are intimately in contact with one another. If an attempt is made to attract and deliver only one of the blanks, therefore, the next blank overlying it may be simultaneously delivered, in some cases. As a measure to counter this double-sheet blank delivery, there may be a proposal, for example, to secure a gap in advance between a blank to be delivered and the next blank in the hopper so that the blank to be delivered and the next blank can be separated from each other by utilizing the gap.

If the gap is previously secured between the blank to be delivered and the next blank, however, the blank to be delivered is quickly separated from the next blank to be detained in the hopper, so that the pressure of air in the gap then sharply lowers, thereby producing suction force between the two blanks. As the blank is delivered, therefore, the next blank is urged to slip out of the hopper outlet, accompanying the blank being delivered. If the suction force exceeds the force of the next blank to be detained in the hopper by means of its elastic force, as this is done, double-sheet blank delivery may occur. In consequence, a defective package may be produced or the operation of the whole system including a blank feeding path and the packaging machine may be interrupted, thus resulting in lowering of the production efficiency of the packaging machine.

DISCLOSURE OF THE INVENTION

An object of the present invention is to provide a feeding apparatus capable of securely delivering material sheets stacked in layers in a hopper one after another.

In a feeding apparatus of the present invention, material sheets are stored in a hopper in a manner such that they are vertically stacked in layers, the hopper having a hopper outlet opening upward or downward, and are restrained from escaping by means of rows of stoppers at the hopper outlet. Further, the feeding apparatus comprises a sucking member capable of getting into and out of the hopper through the hopper outlet. The sucking member can attract and deliver that material sheet which faces the hopper outlet as it gets into and out of the hopper.

In the feeding apparatus of the present invention, the stopper rows are technical means that contributes most to the solution of the aforementioned problems. Each stopper row includes a plurality of stoppers that are arranged at intervals in the longitudinal direction of the material sheets. Each stopper has a guide surface and a restrainer lug. More specifically, the guide surfaces are inclined gradually to reduce the allowable passage width for the material sheets in the direction of delivery by the sucking member, and can guide the side edges of the material sheets as the material sheets are delivered. On the other hand, the restrainer lugs extend from the respective terminal ends of the guide surfaces to the inside of the hopper outlet, and allow only the material sheet attracted to the sucking member to be elastically deformed to get over the restrainer lugs.

If the material sheets are stored in a stack in the hopper that has a downward hopper outlet (for the so-called bottom delivery), for example, the side edges of the lowest sheet and several material sheets that overlie the lowest sheet are supported on the aforesaid guide surfaces. Since the inclination of the guide surfaces gradually reduce the allowable passage width for the material sheets in the direction of delivery or downward, each of the material sheets is contracted in the width direction and elastically deformed into a downwardly convex shape as it descends, while it can be detained in the hopper by means of its restoring force. The lowest material sheet is deformed to the maximum degree, and a gap is formed between the lowest material sheet and the directly overlying material sheet owing to the difference in warps between the material sheets in the direction of delivery.

As the lowest material sheet is delivered by the sucking member, it is further contracted in the width direction with its opposite side edges guided on the guide surfaces, so that the aforesaid gap enlarges further. As this is done, the stopper rows never close the gap, and air introduction passages are formed for the enlarging gap between the individual stoppers. Thus, air can be introduced into the enlarging gap through the spaces between the stoppers during the material delivery, so that the pressure of air in the gap can never lower.

Thereafter, the opposite edge portions of the attracted material sheet are caught by the restrainer lugs. The delivery operation of the sucking member causes the material sheet to be elastically deformed to a higher degree, resisting the catch by means of the restrainer lugs. When the side edges of the material sheet get over the restrainer lugs, the delivery of the lowest material sheet is completed. On the other hand, the material sheets that overlie the lowest one cannot be elastically deformed against the catch by means of the restrainer lugs, and are detained in the hopper with aid of its restoring force, so that securer single-sheet delivery can be achieved.

Preferably, the aforesaid stopper rows are arranged in pairs on the opposite sides of the hopper outlet, respectively so that the opposite side edges of the material sheet can be kept symmetrical as the sheet is regulated and guided. In this case, moreover, the restrainer lugs are arranged symmetrically, so that they can catch the material sheet more securely.

Preferably, the sum total of the respective widths of the guide surfaces contacting the material sheet in each stopper row is adjusted to half or less of the longitudinal dimension of the sheet. In this case, air introduction passages having a width of at least 50% or more in view of the sheet length at one side edge of the material sheet can be secured at the time of delivery.

Preferably, the inclination of the guide surfaces has a gradient of 45° or less to the direction of delivery of the material sheet, in particular. If the inclination of the guide surfaces is within this range, an appropriate gap can be secured between that material sheet which faces the hopper outlet and the next material sheet.

Further, the restrainer lugs extend at a separating angle of 0° to 45° from a plane in contact with the hopper outlet. If the length of extension of the restrainer lugs is fixed, the catch of the material sheet is the strongest with the separating angle of 0°. If the angle exceeds 45° the catch becomes extremely weak. Preferably, therefore, the separating angle of the restrainer lugs should be restricted to the range from 0° to 45°.

Furthermore, the feeding apparatus of the present invention comprises support members. The support members restrain escaping of the material sheets in the hopper at the side edges of the material sheets. The support members are formed having rows of stoppers. The stopper rows support the side edges of the material sheets stacked in the hopper and secure a gap between the material sheet facing the hopper outlet and the material sheet overlying the same. Introduction passages through which the outside air is introduced into the gap during the delivery by the sucking member are formed between the individual stoppers of the stopper rows. Restrainer members are formed individually on the stoppers. When the material sheet is caused to slip out of the hopper outlet and then delivered by the sucking member, the restrainer members can restrain escaping of the next material sheet overlying on the material sheet.

BEST MODE FOR CARRYING OUT THE INVENTION

The present invention can be carried out as a feeding apparatus that can deliver material sheets, such as package blanks to be formed as packaging boxes for filter-tipped cigarettes, one after another and feed the delivered blanks to a packaging machine.

Figure 1:
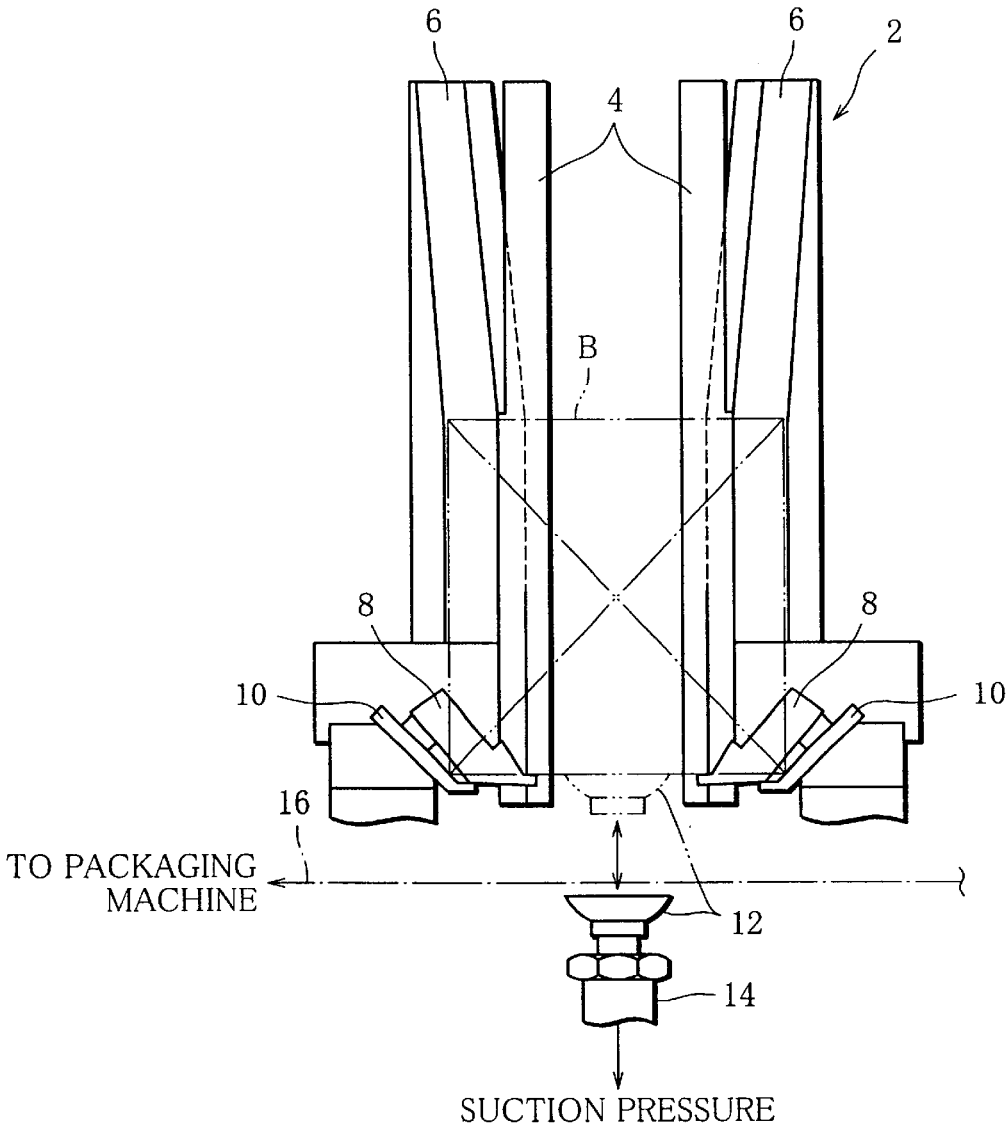
FIG. 1 is a front view of a feeding apparatus according to one embodiment.

Referring to FIG. 1, there is shown the feeding apparatus for the material sheet, which comprises a vertical-type hopper 2. The hopper 2 has guide pillars 4 and 6 in four corners thereof. A vertical hopper passage is defined by the guide pillars 4 and 6. A hopper outlet is formed opening downward from the hopper passage. Package blanks B are vertically stacked in layers in the hopper 2. The four corners of the stack of the package blanks B are guided along the guide pillars 4 and 6. The opposite side edges of the lower end of the stack are supported from both sides on support members 8 and 10, individually, at the outlet of the hopper 2.

A plurality of sucking pads 12 (e.g., four in number) are located facing upward under the hopper 2, and are arranged in a row between the pairs of guide pillars 4 and 6. Only the sucking pad 12 in the foreground is shown in FIG. 1.

The sucking pads 12 are attached to pad holders 14, individually, and all the pad holders 14 are connected to a drive mechanism (not shown). The drive mechanism vertically reciprocates the row of the sucking pads 12, as indicated by arrow in FIG. 1, thereby causing the sucking pads 12 to get into or out of the hopper 2 through the hopper outlet.

Each pad holder 14 has a suction passage (not shown) therein. One end of the passage opens in the sucking surface of the sucking pad 12, and the other end is connected to a suction pressure source (not shown). The supply of suction pressure to the sucking surface is controlled by means of a solenoid on-off valve (not shown), for example. The supply of the suction pressure to the sucking surface is alternatively switched on or off by opening or closing the valve.

The feeding apparatus of FIG. 1 can cause the row of the sucking pads 12 to perform the delivery of the package blanks B by carrying out the operation of the aforesaid drive mechanism and the operation for switching on or off the suction pressure supply in association with each other. More specifically, the row of the sucking pads 12 gets into the hopper 2 at a stroke as it ascends. As this is done, the suction pressure is supplied to the sucking surfaces, whereupon the row of the sucking pads 12 attracts the lower surface of the lowest package blank B. Then, the row of the sucking pads 12 retreats from the hopper 2 as it descends, whereupon the attracted package blank B is drawn out through the hopper outlet.

A conveying plane 16 is defined under the hopper 2. The conveying plane 16 extends from under the hopper outlet toward the packaging machine (not shown). When the row of the sucking pads 12 sinks to a level below the conveying plane 16 as it moves downward, the suction pressure supply is stopped, whereupon the package blank B is released from the attraction. In consequence, the package blank B is separated from the respective sucking surfaces of the sucking pads 12 and is left on the conveying plane 16. The left package blank B is transported along the conveying plane 16 by using a pusher (not shown), for example, from between the hopper 2 and the row of the sucking pads 12.

Figure 2:
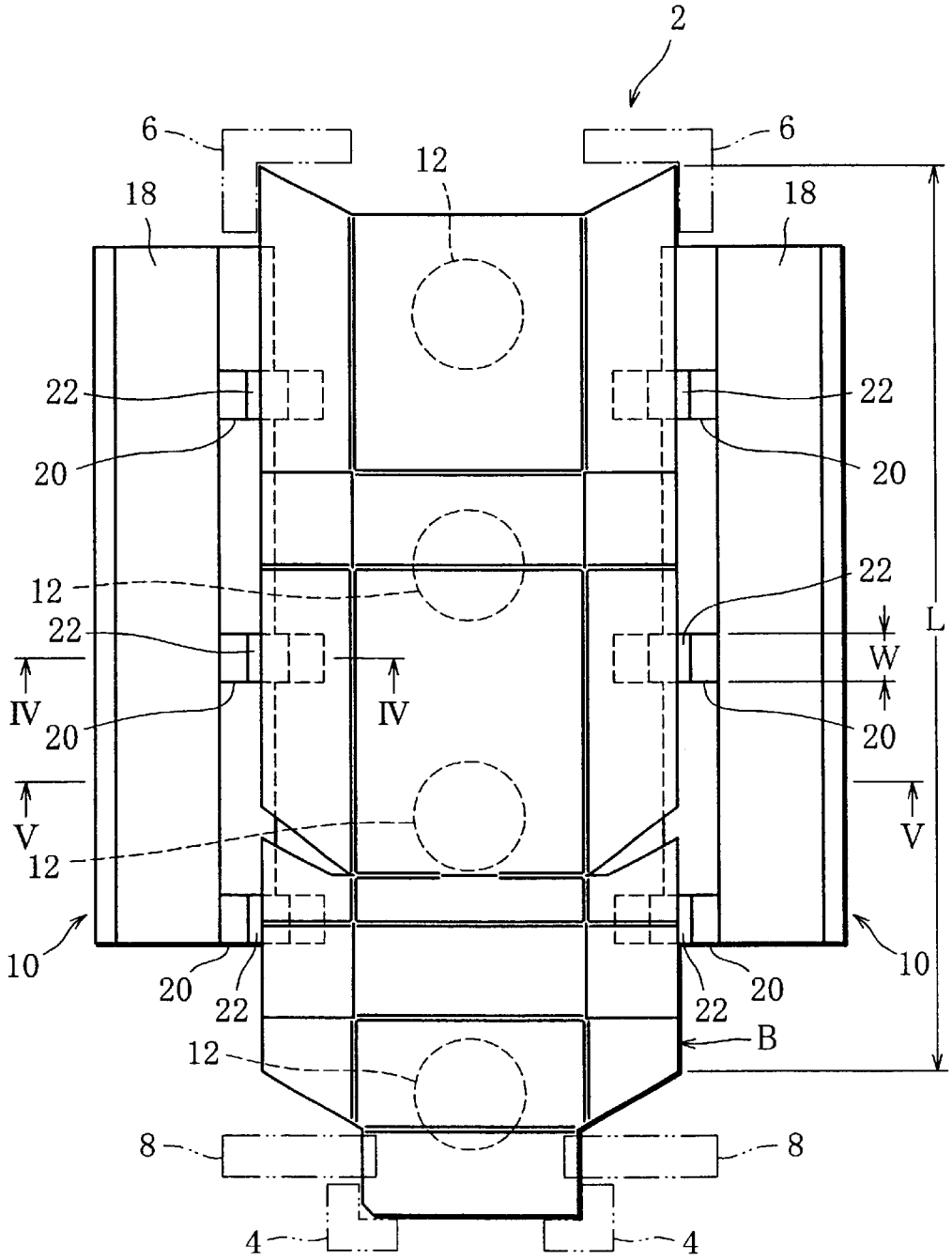
FIG. 2 is a plan view specifically showing a configuration of stopper rows on support members.

FIG. 2 specifically shows the way the package blank B is supported in the hopper 2 on the support members 8 and 10 and the arrangement of these members. The package blank B is shaped to match the construction of a packaging box (e.g., hinged-lid pack) to be formed. When the package blank is held in the hopper 2, the longitudinal direction thereof extends between the guide pillars 4 and 6.

The aforesaid support members 10 support the opposite side edges of the package blank B in the longitudinal direction of the blank B. More specifically, each support member 10 has a rectangular base plate 18, and a plurality of stopper guides 20 (three in number in FIG. 2) are mounted on the base plate 18. These stopper guides 20 are arranged substantially at equal spaces on the base plates 18 and in rows along the opposite side edges of the package blank B. The opposite side edges of the package blank B are supported on the stopper guides 20 only. In this state, the rows of the stopper guides 20 restrain the stack of the package blanks B from slipping out of the hopper outlet. The stack of the package blanks B is not directly in contact with the base plates 18. The support members 8 are situated inside the hopper 2 than the rows of the stopper guides 20 on both sides, and partially supports the lower surface of the stack near the guide pillars 4.

A width W of each individual guide surface 22 shown in FIG. 2 can be defined as the width of contact between the guide surface 22 and the package blank B. If an overall length L of one side edge of the package blank B is defined as its longitudinal dimension, for example, the sum total of the respective contact widths of the support members 10 is adjusted to half or less of the longitudinal dimension of the package blank B ($3 \times W \leqq L/2$).

Figure 3:
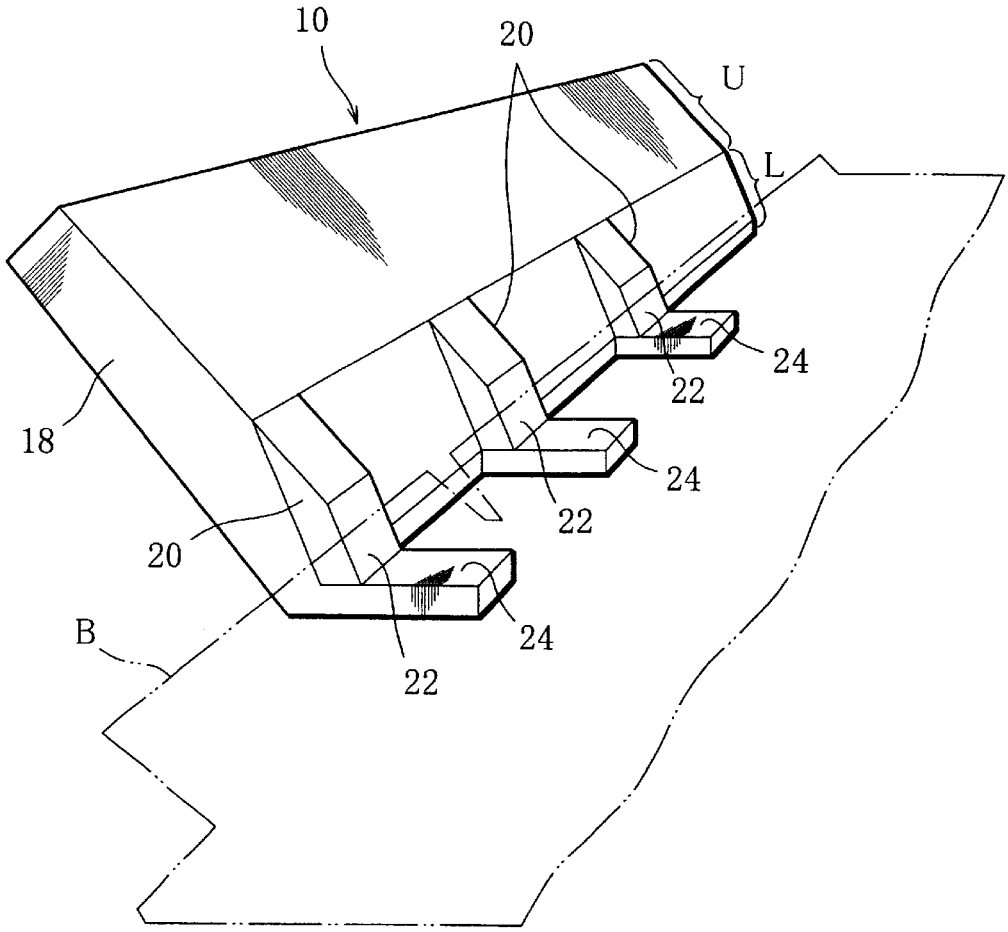
FIG. 3 is a perspective view of the support member specifically showing individual stopper guides, their guide surfaces, restrainer lugs, etc.

FIG. 3 specifically shows the construction of the support member 10. As is also evident from FIG. 1, the base plate 18 is fixed in a posture inclined at an angle to the hopper 2, and its upper surface declines from the flank of the hopper 2 toward the hopper outlet. Further, the upper surface is divided into upper and lower regions U and L that are inclined at different angles. The angle of inclination of the lower region L is wider than that of the upper region U. The stopper guides 20 are spaced and attached to the lower region L of the base plate 18. The stopper guides 20 protrude from the lower region L. The individual stopper guides 20 have their respective guide surfaces 22 for supporting the opposite side edges of the package blank B in the hopper 2, as mentioned before. The guide surfaces 22 are inclined downward or in the delivery direction so that the allowable passage width for the package blank B is reduced gradually.

The support member 10 is formed integrally having restrainer lugs 24 that are continuous with the individual stopper guides 20 and protrude from one side edge of the base plate 18. The restrainer lugs 24 extend from the respective terminal ends of the guide surfaces 22 toward the inside of the hopper outlet, that is, toward its center.

Figure 4:
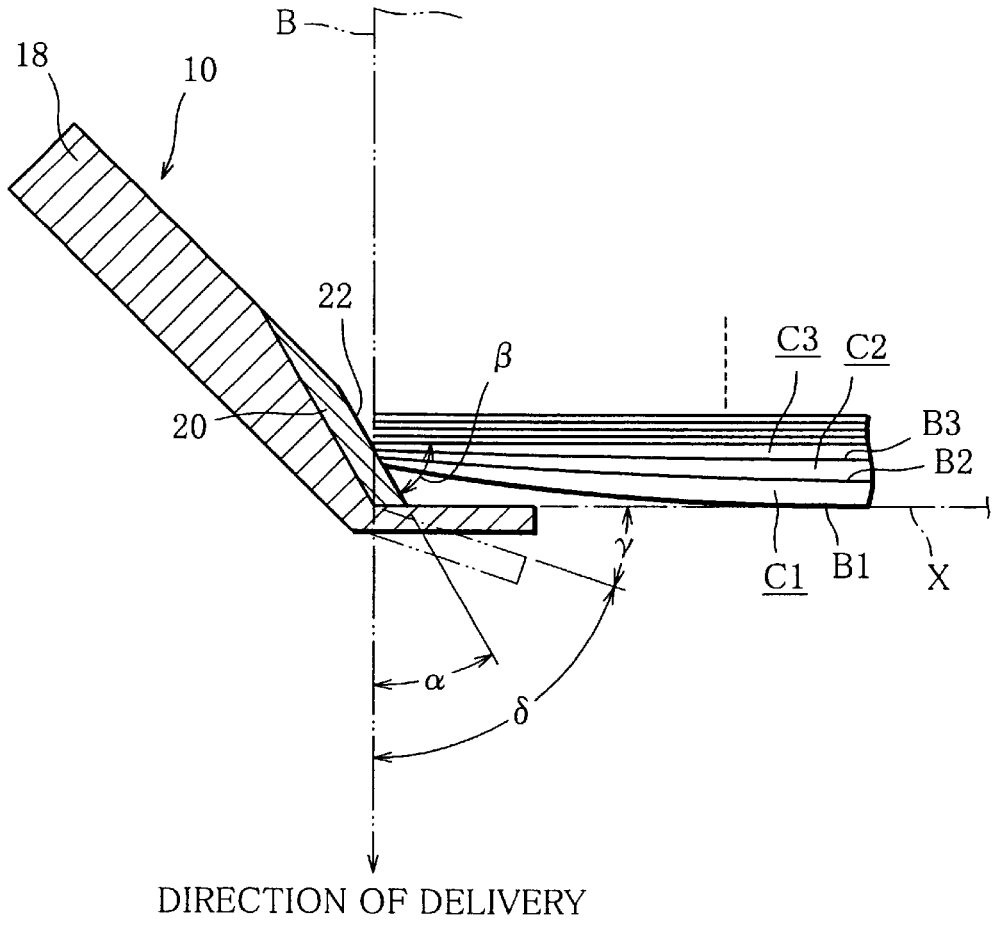
FIG. 4 is a sectional view taken along line IV—IV of FIG. 2 and showing details of the guide surfaces and the restrainer lugs.

FIG. 4 specifically shows the way the package blanks B are supported on the guide surfaces 22. The lower part of the stack of the package blanks B, that is, the lowest package blank B1 and several overlying package blanks B2, B3, etc., are supported directly on the guide surfaces 22 and upper package blanks B are further placed on the lower part. The specific number of package blanks that are supported directly above the lowest one on the guide surfaces 22 cannot be assigned, since it varies depending on the properties of the material and the height of the stack of the package blanks B, the angle of inclination of the guide surfaces 22, etc.

In the state of FIG. 4, the opposite side edges of the lowest package blank B1 and the package blanks B2, B2, etc. above the blank B1 are displaced inward along the inclination of the guide surfaces 22, so that the blanks are contracted correspondingly in the width direction. This contraction in the width direction elastically deforms all the package blanks B1, B2, B3, etc. into a downwardly convex shape, as illustrated, whereupon gaps C1, C2, C3, etc. are formed between the upper and lower package blanks B, respectively. The degree of contraction of blanks B in the width direction thereof has its maximum with respect to the lowest blank B1, and diminishes with increasing distance from the lowest blank B1, so that the bend of the lowest package blank B1 is the greatest.

When the lowest package blank B1 is delivered by the aforesaid row of the sucking pads 12, the package blank B1 is already separated from the directly overlying package blank B2 with the gap C1 between them. Therefore, the sucking pads 12 can attract the desired package blank B1 only and deliver the blank B1 with ease. As the package blank B1 is delivered, moreover, the respective guide surfaces 22 of the stopper guides 20 guide the opposite side edges of the package blank B1.

If the direction of delivery of the package blanks B is the vertical downward direction, for example, the hopper 2 is set upright, so that the stored package blanks B are stacked in layers in a horizontal posture. The respective guide surfaces 22 of the stopper guides 20 have a gradient equal to an angle $\alpha$ to the direction of delivery of the package blanks B. In order to secure the aforesaid gaps C1, C2, C3, etc. satisfactorily, the angle $\alpha$ should preferably be adjusted to 45° or less. If the lower surface of the package blanks B that is kept in the horizontal posture in the hopper 2 is a horizontal surface, a separating angle $\beta$ between the lower surface and the guide surfaces 22 should preferably be set to 45° or more.

The restrainer lugs 24 originally have a function to restrain the next package blank B2 from slipping out of the hopper outlet, accompanying the package blank B1 to be delivered. More specifically, the restrainer lugs 24 can catch the package blank B2 at the hopper outlet and restrain the escape of the package blank B2 so that the package blank B2 is pushed back into the hopper 2 with aid of repulsive force thereof. On the other hand, the package blank B1 can be drawn out of the hopper 2, resisting the catch by means of the restrainer lugs 24, and the opposite side edges of the blank B1 can get over the restrainer lugs 24 in a manner such that they are further elastically deformed.

If the outlet of the hopper 2 is horizontal as viewed in FIG. 4, a plane including the outlet is defined as a horizontal plane X on the respective upper surfaces of the restrainer lugs 24. In the example of FIG. 4, the restrainer lugs 24 extend horizontally along the hopper outlet. Alternatively, however, the restrainer lugs 24 may be inclined downward, as indicated by two-dot chain line in FIG. 4. The degree of this inclination can be defined as a separating angle $\gamma$ between the restrainer lugs 24 and the horizontal plane X on the hopper outlet, for example. Preferably, the separating angle $\gamma$ should be set within the range from 0° to 45°, for example. If the inclination of the restrainer lugs 24 is viewed in the direction of delivery of the package blanks B, on the other hand, its gradient $\delta$ should preferably be 45° or more or perfectly perpendicular. Even in the case where the inclination is given in this manner, the restrainer lugs 24 can satisfactorily fulfill their essential functions.

The following is a description of the delivery operation carried out by the specific embodiment or the feeding apparatus according to the present invention.

According to the present embodiment, the package blanks B are delivered from the hopper 2 in the feeding apparatus of FIG. 1. The package blanks B are material sheets from which packages (hinged-lid packs) for filter cigarettes are formed. As mentioned before, the package blanks B are stored stacked in layers in the hopper 2, and the lowest package blank B1 from the stack is attracted by the row of the sucking pads 12 and delivered. The delivery operation can be continued as the sucking pads 12 reciprocate vertically. In connection with the present embodiment, however, a cycle of delivery operation will be described.

Figure 5:
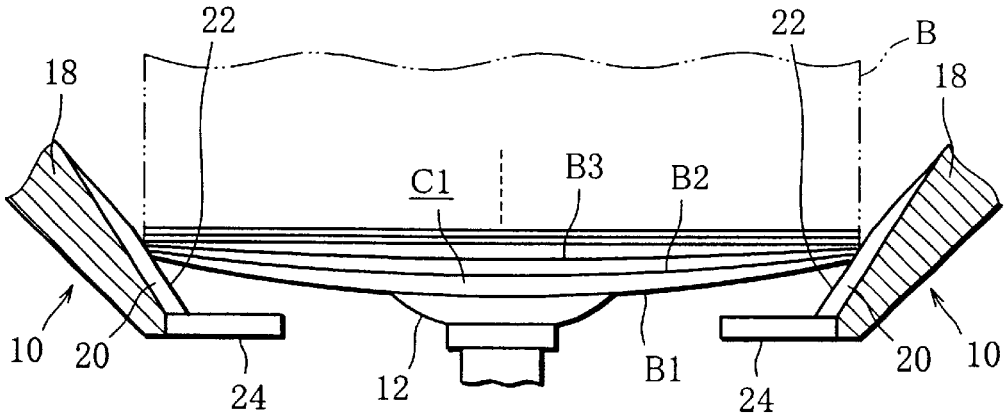
FIG. 5 is a sectional view taken along line V—V of FIG. 2 and illustrating the way of delivery of package blanks.

FIG. 5 shows a state in which the row of the sucking pads 12 is caused to ascend and get into the hopper 2. In this state, the respective sucking surfaces of the sucking pads 12 are in contact with the lower surface of the package, blank B1, and is supplied with the suction pressure to attract the lower surface. Thereafter, the row of the sucking pads 12 is lowered at a stroke by the aforesaid drive mechanism, and starts to draw out the attracted package blank B1 from the hopper 2.

Figure 6:
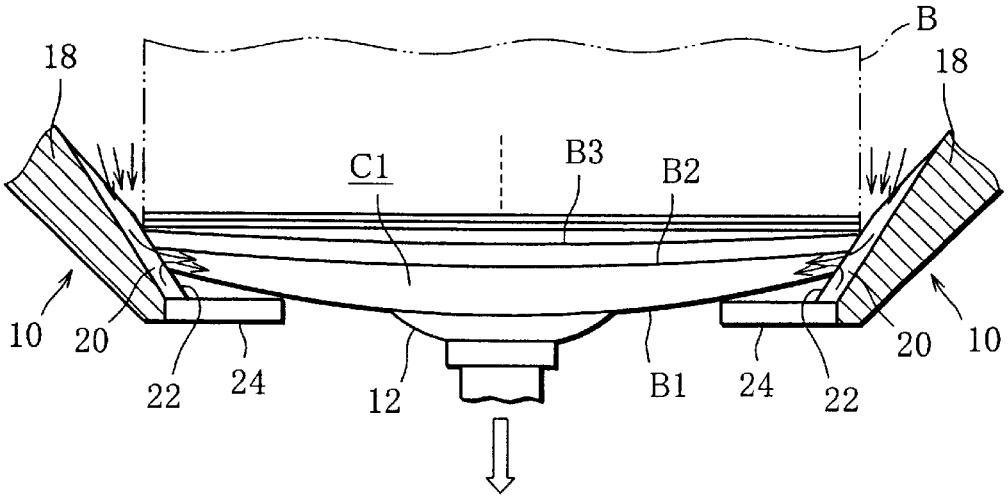
FIG. 6 is a view showing a state subsequent to the state of FIG. 5, in which the lowest package blank starts to be drawn out.

FIG. 6 shows the way the row of the sucking pads 12 actually descends. When the package blanks B are stored in the hopper 2, as described before, the gap C1 is defined between the lowest package blank B1 and the directly overlying package blank B2. As the sucking pads 12 descend, therefore, the package blank B1 is easily separated from the package blank B2 and descends with its opposite side edges guided on the respective guide surfaces of the stopper guides 20. As the package blank B1 descends, it is contracted in the width direction between the guide surfaces 22 and is elastically deformed into a downwardly convex shape of a higher degree than in the state of FIG. 5.

On the other hand, the gap C1 enlarges as the package blank B1 descends. In this state, the rows of the stopper guides 20 contacts with the package blanks B1 and B2 only on their guide surfaces 22. Therefore, the spaces between the respective opposite side edges of the lowest package blank B1 and the directly overlying package blank B2 are not fully closed, so that the gap C1 between the blanks opens into the outside air through the spaces between the stopper guides 20. Thus, air is introduced into the gap C1 also through the spaces between the stopper guides 20, as indicated by arrows in the drawing, so that the air pressure can be prevented from suddenly lowering.

Although the gap C1 also opens into the outside air at the front and rear ends of the package blank B1, the width of the opening is narrower than that between the opposite side edges. If the package blank B1 is delivered at high speed, therefore, the quantity of air that externally gets into the gap C1 cannot catch up with the enlargement of the capacity of the gap C1, so that the air pressure in the gap C1 lowers, thus resulting in occurrence of excessive suction force. In order to prevent the occurrence of excessive suction force in the gap C1, therefore, air must be quickly introduced into the gap C1 as the package blank B1 is delivered.

The inventors hereof confirmed that the sum total of the respective widths W of the guide surfaces 22 should be adjusted to half or less of the longitudinal dimension L in order to secure a sufficient quantity of air supply to the gap C1, in consideration of the relation between the speed of delivery of the package blank B1 and the rate of air introduction into the gap C1.

Figure 7:
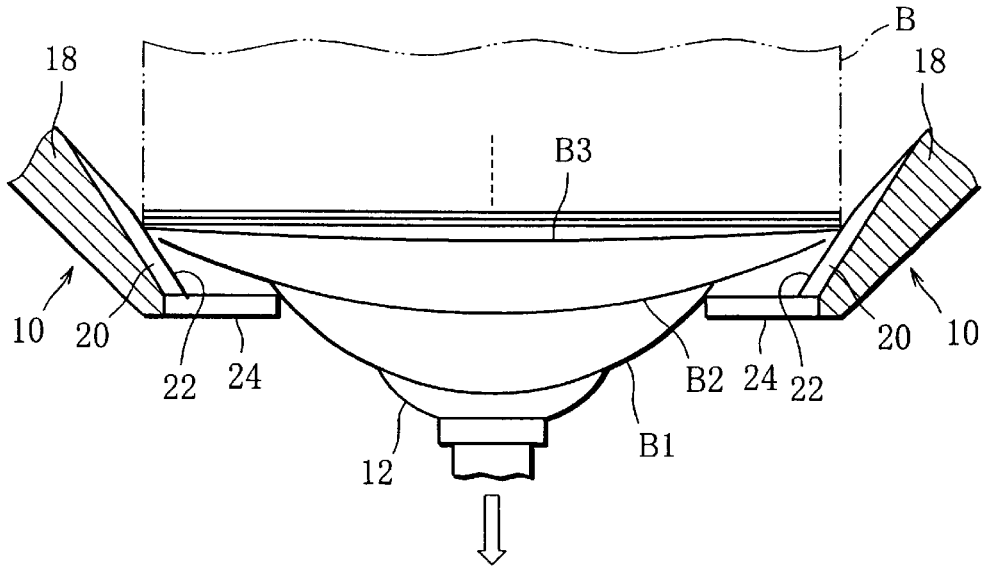
FIG. 7 is a view showing a state subsequent to the state of FIG. 6 and illustrating the way the restrainer lugs catch the package blank.

FIG. 7 shows the way the restrainer lugs 24 catch the package blank B1. The package blank B1, as illustrated, is urged to slip out of the hopper outlet, resisting the catch by means of the restrainer lugs 24, so that the package blank B1 is pulled out by the sucking pads 12 and elastically deformed to a high degree. When the opposite side edges of the package blank B1 get over the restrainer lugs 24, thereafter, the package blank B1 can entirely slip out of the hopper outlet. Even if there is no quickly lowering of the air pressure in the gap C1, the overlying package blank B2 is attracted to the package blank B1 under suction force that is attributable to a slight reduction of the air pressure.

Figure 8:
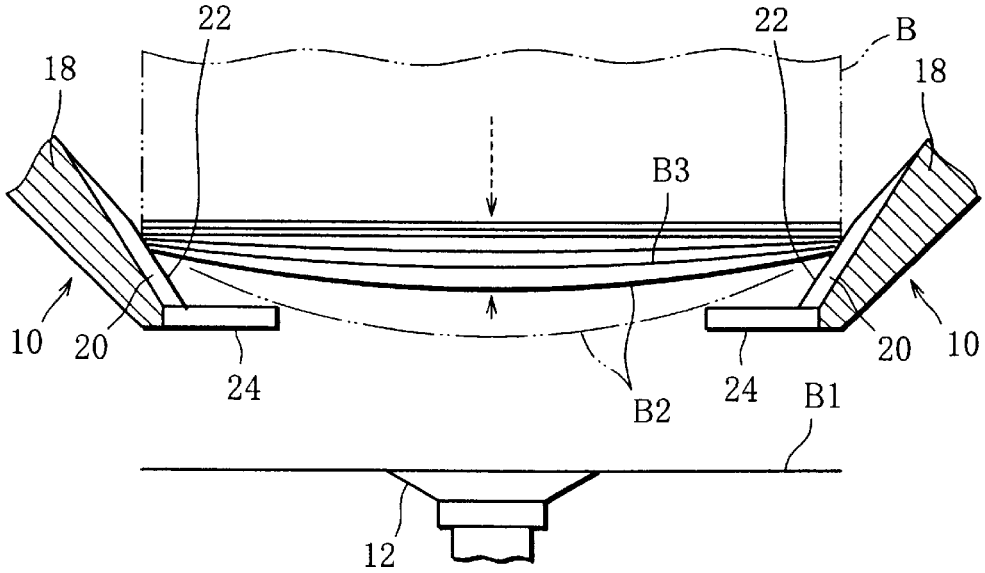
FIG. 8 is a view showing a state subsequent to the state of FIG. 7, in which the delivery of the package blank is completed.

FIG. 8 shows a state in which the package blank B1 is entirely ejected from the hopper outlet. In this state, the package blank B1 is restored to its original flat posture with aid of its restoring force. On the other hand, the overlying package blank B2 cannot be elastically deformed against the catch of the restrainer lugs 24 with the small suction force only, and is kept in the hopper 2 by the restoring force. As this is done, the package blank B2 ascends with its opposite side edges guided along the guide surfaces 22, and is situated at the bottom as the next object to be delivered. The stack overlying the package blank B2 sinks inside the hopper 2 for a thickness of the delivered package blank B1.

Although the embodiment described above relates to the case of bottom delivery, the package blanks B may be delivered in a top delivery mode. In the case of top delivery, an upward urging force is applied to the stack of the package blanks B from its bottom side by means of a spring, for example. The support members 8 and 10 can restrain the escape of the stack, resisting the upward urging force, and contract the overlying package blanks B in the width direction along the guide surfaces 22, thereby deforming them into an upwardly convex shape.

The present invention is not limited to the one embodiment described above, and various modifications may be effected therein. Although the base plate 18 of each support member 10 is fitted with the stopper guides 20 and the restrainer lugs 24, according to the one embodiment, each stopper guide 20 and each restrainer lug 24 may be made of independent members. In this case, the support member 10 is not integral, and the stopper guides 20 and the restrainer lugs 24 are individually attached to the hopper 2. Further, the specific shapes, number, configurations, etc. of the stopper guides 20 and the restrainer lugs 24 are not specially limited, and may be suitably changed according to the material used.

Although the vertical-type hopper is given as an example according to the one embodiment, the hopper of the present invention may be of a slant type such that the material sheets can be stacked obliquely in layers.

Besides, the feeding apparatus of the present invention is suitably applicable to various material sheets as well as to packaging blanks. It is to be understood that the specific configurations of the hopper 2, support members 10, sucking pads 12, etc. according to the one embodiment may be variously modified or replaced with their equivalent members.

As described above, the feeding apparatus for material sheets of the present invention enables secure single-sheet delivery and greatly contributes to steady continuous material supply. Since it never lowers the production efficiency of the packaging machine or the like that uses material sheets, moreover, the higher the speed of its operating cycle, the greater the effects it can produce are.

The following is a description of the advantages of the present invention based on the definite specifications of stopper rows. First, if a pair of stopper rows are arranged individually on the opposite sides of the material sheets, the behavior of each material sheet is stabilized during delivery, so that the delivery operation is smooth.

If the sum total of the respective contact widths of the guide surfaces is within an appropriate range, air can be securely introduced into the aforesaid gap, so that the material sheets that are not expected to be delivered can never fail to be detained in the hopper.

If the inclination of the guide surfaces is within an appropriate range, in particular, the material sheets can be securely separated in the hopper, and only the material sheet that is expected to be delivered can be securely attracted and drawn out.

If the separating angle of the restrainer lugs is set within an appropriate range, the material sheets that are not expected to be delivered can never fail to be restrained from slipping out, and only the one desired material sheet can be securely delivered at a time.

What is claimed is:

1. A feeding apparatus for material sheets, comprising:

a hopper having a hopper outlet opening upward or downward and storing material sheets vertically stacked in layers toward the hopper outlet;

a sucking member capable of moving into and out of said hopper through the hopper outlet and adapted to attract and deliver a leading material sheet which faces the hopper outlet as said sucking member moves into and out of said hopper;

support members for restraining escaping of the material sheets in said hopper at side edges of the material sheets;

rows of stoppers formed on said support members, supporting the side edges of the material sheets stacked in said hopper, and securing a gap between the leading material sheet to be delivered by means of said sucking member through the hopper outlet and the next material sheet immediately adjacent to the leading material sheet;

introduction passages formed between said individual stoppers of said stopper rows and capable of introducing the outside air into the gap during the delivery by means of said sucking member; and restrainer members formed individually on said stoppers and adapted to restrain escaping of the overlying material sheet when the material sheet is delivered and caused to slip out of the hopper outlet by means of said sucking member.

2. A feeding apparatus for material sheets, comprising:

a hopper having a hopper outlet opening upward or downward and storing material sheets vertically stacked in layers toward the hopper outlet;

rows of stoppers arranged at intervals in a longitudinal direction of the material sheets and capable of restraining escaping of the material sheets in said hopper at side edges of the material sheets;

a sucking member capable of moving into and out of said hopper through the hopper outlet and adapted to attract and deliver a leading material sheet which faces the hopper outlet as said sucking member moves into and out of said hopper;

guide surfaces formed on said individual stoppers of said stopper rows, inclined gradually to reduce an allowable passage width for the material sheets in the direction of delivery by means of said sucking member, and adapted to guide the side edges of the material sheets as the material sheets are delivered; and restrainer lugs formed on said individual stoppers, extending from respective terminal ends of said guide surfaces to the inside of the hopper outlet, and allowing only the material sheet attracted to said sucking member to be elastically deformed to get over said restrainer lugs.

3. The feeding apparatus for material sheets according to claim 2, wherein said stopper rows are arranged in a pair on opposite sides of the hopper outlet.

4. The feeding apparatus for material sheets according to claim 2, wherein a sum total of respective widths of contact between said guide surfaces for each of said stopper row and the material sheet is adjusted to half or less of a longitudinal dimension of the material sheet.

5. The feeding apparatus for material sheets according to claim 2, wherein said guide surfaces have a gradient of 45° or less to the delivery direction of the material sheet.

6. The feeding apparatus for material sheets according to claim 2, wherein said restrainer lugs extend at a separating angle of 0° to 45° to a plane including the hopper outlet.

* * * * *